US009643805B2

(12) United States Patent
Fenile et al.

(10) Patent No.: US 9,643,805 B2
(45) Date of Patent: May 9, 2017

(54) DEVICE FOR SEPARATING INDIVIDUAL, TWO-DIMENSIONAL, FLEXIBLE OBJECTS FROM THE LOWER SIDE OF A STACK

(71) Applicant: FERAG AG, Hinwil (CH)

(72) Inventors: Roberto Fenile, Wetzikon ZH (CH); Marc-Andreas Benz, Gruet (CH)

(73) Assignee: FERAG AG, Hinwil (CH)

( * ) Notice: Subject to any disclaimer, the term of this patent is extended or adjusted under 35 U.S.C. 154(b) by 0 days.

(21) Appl. No.: 13/970,988

(22) Filed: Aug. 20, 2013

(65) Prior Publication Data

US 2014/0054842 A1 Feb. 27, 2014

(30) Foreign Application Priority Data

Aug. 22, 2012 (CH) ..... 1440/12

(51) Int. Cl.
*B65H 3/32* (2006.01)
*B65H 3/08* (2006.01)
*B65H 3/48* (2006.01)

(52) U.S. Cl.
CPC ..... *B65H 3/32* (2013.01); *B65H 3/0875* (2013.01); *B65H 3/48* (2013.01); *B65H 2403/512* (2013.01); *B65H 2404/152* (2013.01); *B65H 2405/111* (2013.01); *B65H 2701/1932* (2013.01)

(58) Field of Classification Search
CPC ..... B65H 3/0808; B65H 3/0875; B65H 3/32; B65H 3/38; B65H 2404/152
USPC ..... 271/19–21, 23, 99, 100–102, 104, 131, 271/132, 137, 138
See application file for complete search history.

(56) References Cited

U.S. PATENT DOCUMENTS

| | | | | |
|---|---|---|---|---|
| 1,945,248 | A * | 1/1934 | Winkler et al. | 271/95 |
| 2,927,792 | A | 3/1960 | Goss | |
| 3,394,930 | A * | 7/1968 | Guggisberg | 271/11 |
| 5,622,361 | A * | 4/1997 | Cole, Jr. | 271/16 |
| 6,015,145 | A * | 1/2000 | Hartel | 271/98 |
| 6,070,866 | A * | 6/2000 | Wepfer | 271/10.11 |
| 6,332,607 | B1 * | 12/2001 | Van Der Werff | 271/101 |
| 6,634,635 | B2 * | 10/2003 | Kaya et al. | 271/97 |
| 6,698,749 | B2 * | 3/2004 | Muller | 271/99 |
| 8,556,252 | B2 * | 10/2013 | Merkli | 271/101 |

FOREIGN PATENT DOCUMENTS

| | | |
|---|---|---|
| EP | 0927692 | 7/1999 |
| EP | 1 506 931 | 2/2005 |
| FR | 2585682 | 2/1987 |
| GB | 248213 | 3/1926 |

(Continued)

*Primary Examiner* — Ernesto Suarez
(74) *Attorney, Agent, or Firm* — Rankin, Hill & Clark LLP

(57) ABSTRACT

A device for separating individual, two-dimensional, flexible objects from the lower side of a stack of such objects and for conveying the separated objects away from the stack. The device includes a stack space with a support region, and a support member that supports the stack from below in the support region. The support member includes a support roller arrangement of a plurality of support rollers. The device further includes at least one separating member for separating the objects from the lower side of the stack in the support region. The support roller arrangement is part of a roller guidance device and is translatorily movable to and from between a support position and a release position.

17 Claims, 6 Drawing Sheets

(56) References Cited

FOREIGN PATENT DOCUMENTS

| | | |
|---|---|---|
| GB | 411061 | 5/1934 |
| JP | 7133022 | 5/1995 |
| WO | 01/32539 | 5/2001 |
| WO | 02/42189 | 5/2002 |

* cited by examiner

DEVICE FOR SEPARATING INDIVIDUAL, TWO-DIMENSIONAL, FLEXIBLE OBJECTS FROM THE LOWER SIDE OF A STACK

BACKGROUND OF THE INVENTION

Field of the Invention

The invention lies in the field of conveying two-dimensional, flexible objects, in particular printed products. The invention relates to a device for separating such objects from the lower side of a stack consisting of these objects and for conveying the separated objects away from the stack. The device comprises a stack space with a support region and support means supporting the stack from below in the support region, wherein the support means comprise at least one support roller arrangement of at least one support roller. Moreover, the device comprises at least one separating member for separating the objects from the lower side of the stack.

Moreover, the invention also relates to a method for separating individual, two-dimensional, flexible objects from the lower side of a stack of such objects and for conveying the separated objects away from the stack by way of a device according to the invention.

Description of Related Art

Such devices are known from the state of the art. Thus for example EP 1 226 083 B1 describes different embodiments of devices for separating individually printed products from the lower side of a printed product stack.

According to a first embodiment according to FIGS. 1 to 5, the stack on the one hand is supported over part of the surface on a stationary rest table and on the other hand on a movably arranged support disk pair. The rest table and the support disk pair form a horizontal rest surface. The support disks are rotatingly mounted about a vertical axis. The support disk pairing forms a release recess which in a release position below the stack forms an opening for the suction members and for bending away and pulling off the printed products. The release recess is periodically led through below the stack by way of the rotation of the support disks.

The rotating support disks on the stack lower side however produce a surface friction, i.e. they drag along the lower side of the stack. This procedure can led to a damaging of the lowermost product and generally to disturbances in the process procedure, such as e.g. an uncontrolled displacement of the printed products in the stack.

According to a second embodiment according to FIGS. 7 to 9, the device comprises a carrier wheel which is arranged below the stack and which rotates about an essentially horizontal axis. In each case, pairs of a sucker and a gripper assigned to the sucker are arranged on the periphery of the carrier wheel. Moreover, the device comprises a support means in the form of a roller carpet which on the one hand supports the stack from below and on the other hand comprises at least one removal opening, through which the respective lowermost printed product is gripped by a sucker, and can be bent against the gripper assigned to the sucker and transferred to this gripper, for separation from the stack. The roller carpet comprises a plurality of rollers which are mounted in a freely rotatable manner, are aligned parallel to one another and horizontally, and are moved along a revolving (which is to say circulatory) path in a revolving device. The rollers thereby are moved through below the stack in a manner directed essentially equally with the suckers and grippers.

A device is described in WO 2008/000099 A1, which serves the same purpose. Here too, a roller carpet is present, wherein the rollers of the roller carpet are fastened on a roller wheel which for example revolves on the same axis as the as the carrier wheel. The rollers run along a non-circular revolving path, along which the distance between the rollers is varied. The rollers are moreover articulately coupled on the roller wheel by way of levers, in a manner such that the levers are pivotable parallel to the rotation plane of the roller wheel. An unambiguous revolving or revolving path of the rollers and an unambiguous and always constant movement course of the rollers along this revolving path are defined by a roller guidance which controls the movement of the rollers along the revolving path.

EP 1 254 855 B1 likewise shows a roller carpet, with which the rollers are fastened on a roller wheel. In order to open the roller carpet in a certain region, the rollers are tilted away and specifically about a tilt axis which runs essentially radially or secantially to the roller wheel. A cam control is provided for pivoting the rollers. A wheel rolling on a cam moves the rollers via a lever mechanism with several levers.

EP 2 128 055 A2 likewise describes a device for separating printed products from a lower side of a printed product stack and for conveying away the separated printed products. The device comprises a stack space with a support region, in which the stack is supported to the bottom. Moreover, the device likewise comprises a revolving roller carpet with a plurality of rollers which are freely rotatable about their longitudinal axis and are moved through the support region and thereby support the stack to the bottom. The device moreover comprises revolving sucker and gripper pairings for separating the objects from the lower side of the stack and for the transport-away of these. The rollers in the support region are moved past below the stack in a manner directed equally with the suckers and grippers. The rollers of the roller carpet are coupled onto a roller wheel. The coupling according to this embodiment is designed such that the rollers with their longitudinal axis are pivotable relative to the roller wheel.

CH 637 087 describes a device for separating printed products from the lower side of a printed products stack and for conveying away the separated printed products. A support means in the form of a roller grate with a plurality of rollers is arranged below the stack. The rollers of the roller grate are likewise moved in a revolving device along a revolving path, wherein the revolving path runs through the support region of the stack.

CH 598 106 likewise describes a device for separating printed products from the lower side of a printed product stack and for conveying away the separated printed products. Here too, the support means for supporting the stack comprise rollers which are moved in a revolving manner and which are led through the support region of the stack rest.

Common to the publications mentioned above is the fact that the rollers of the support means are led in a revolving manner in a revolving device and in this manner are moved through the support region of the stack rest. According to particular embodiments of the publication cited above, the rollers of the roller carpet are additionally pivotable with their longitudinal axis.

The described devices have the disadvantage that these have comparatively large dimensions and accordingly assume much space on account of the roller carpets or roller grates, which are guided in a revolving manner. If moreover the devices comprise pivotably guided support rollers, then these have even greater dimensions.

However, for certain applications it can be advantageous or even necessary for the device to have a compact and thus space-saving construction manner. This object however can hardly be achieved with a circulatorily (revolvingly) guided support roller arrangement.

BRIEF SUMMARY OF THE INVENTION

It is therefore the object of the present invention to put forward a device for separating printed products from the lower side of a printed product stack and for conveying away the separated printed products, said device comprising support means for supporting the object stack and for permitting a compact and space-saving construction manner of the device. The support means however should ensure an as disturbance-free as possible operation of the device, even at high processing speeds.

The object is achieved by the features of the device claim 1 and of the method claim 13. Advantageous further developments and embodiments of the invention are to be deduced from the dependent claims, the description and the drawings. Thereby, features of the method claims can analogously be combined with the features of the device claims and vice versa.

The device for separating individual, two-dimensional, flexible objects from the lower side of a stack of such objects and for conveying the separated objects away from the stack, as already mentioned comprises:

- a stack space with a support region;
- support means supporting the stack from below in the support region, wherein the support means comprise at least one support roller arrangement with at least one support roller; as well as
- at least one separating member for separating the objects from the lower side of the stack, in the support region.

The invention is then characterised in that the support roller arrangement is part of a roller guidance device, and the support roller arrangement is movable periodically between a support position and a release position.

The support roller arrangement is movable in particular to and fro between the support position and the release position.

According to a further development of the invention, the support roller arrangement is movable periodically as well as, at least in sections, translatorily, in particular movable to and fro. The support roller arrangement can also be movable periodically as well as exclusively translatorily, in particular movable to and fro.

Translatorily means a straight-lined or linear movement of the support rollers of the roller arrangement.

However, it is also possible for the support roller arrangement or their support rollers to be movable periodically at least in sections along a curved movement path, in particular movable to and fro. The support roller arrangement or its support rollers can also be movable periodically, exclusively along a curved movement path, in particular movable to and fro.

In the release position, the device in the support region below the stack forms a maximal release gap, through which gap the objects can be bent away downwards. The release gap preferably extends transversely to the movement direction of the support roller arrangement. The term "downwards" relates to the direction of gravity.

In the support position however, the support roller arrangement is arranged in the region of the release gap below the stack. The support roller arrangement supports the stack to the bottom at least over part of the surface, in the support position, The device in the support position preferably likewise comprises a release gap which e.g. is so wide that this permits the transport away of a bent-away object below the stack space. This release gap however is significantly narrower than the maximal release gap in the release position. If a stationary support arrangement or a guide roller of the subsequently described type connecting to this is provided, then the release gap in the support position is formed between the stationary support arrangement and the guide roller.

The to and fro movement describes a movement of the support rollers or of the support roller arrangement in a release direction, in which the release gap opens or is enlarged, and in a support direction which is opposite the release direction and in which the release gap reduces again due to the moved back or retracted support roller arrangement.

The two-dimensional, flexible objects are preferably printed products such as newspapers, magazines, periodicals, brochures, advertisement attachments, individual sheets, leaflets, flyers etc.

The support means can comprise one, two or more than two support roller arrangements. If the support means comprise two support roller arrangements, then these can be arranged next to one another considered in the movement direction of the support roller arrangement. Moreover, the two support roller arrangements can be formed mirror-symmetrically to one another.

The support rollers are preferably moved exclusively translatorily to and fro. In particular, the support roller arrangement as a unit can be translatorily moved to and fro at least in sections, preferably exclusively.

The support roller arrangement, considered in the movement direction of the support roller arrangement, can comprise only one support roller. The support roller arrangement however preferably comprises two, three, four or more than four support rollers which are arranged one after the other in the movement direction of the support roller arrangement. The axes or the rotation axes of the support rollers run preferably transversely to the movement direction of the support roller arrangement. The support rollers are preferably rotatably mounted in lateral holders. The lateral holders can be receiver profiles.

The support roller arrangement can further comprise one or more support rollers on a common rotation axis.

According to a preferred further development of the invention, the roller guidance device comprises two support roller arrangements of the type described above, which are arranged next to one another considered in the movement direction. A central gap, through which the at least one separating member can be moved towards the support region for the purpose of gripping the lowermost object of the stack, is formed between the support roller arrangements. The central gap preferably extends along the movement direction of the support roller arrangement.

The support roller arrangements or their lateral holders are preferably linearly movably guided in a guidance device which is actively connected to the lateral holders. The holders thereby preferably have the function of a carriage and with the guidance device form a carriage guide. The guidance device can e.g. comprise guide profiles which receive the holders in a displaceably guided manner.

The support roller arrangement is preferably connected to the device via a link mechanism. The link mechanism is designed such that this converts a non-linear, e.g. rotary cam movement into a translatory movement of the support roller arrangement.

The device preferably comprises control means, by way of which the movement of the support rollers or of the support roller arrangement can be controlled cyclically synchronously to the separating procedure. Cyclically synchronously to the separating procedure, in particular means a movement of the support roller arrangement which is cyclically synchronous to the movement of the separating members. The cyclically synchronous movement is yet explained in more detail further below in combination with the description of the method.

The control means preferably comprise a control cam which is moved for example by a cam roller. The cam roller can be actively connected to the roller guidance device via a cam arm. The guidance of the cam roller along the control cam effects a deflection of the cam arm, wherein the deflection of the cam arm into a translatory movement of the support rollers or of the support roller arrangement is effected via a link mechanism.

The control cam can e.g. be coupled to the take-over device which is hereafter described in more detail and in which the separating members and, as the case may be also transport members, are revolvingly moved.

The movement of the support roller arrangement can however also be effected via an independent drive. This drive however is controlled preferably via the central machine control, so that a cyclically synchronous movement of the support roller arrangement with the movement of the separating elements or the transport elements is possible.

The roller guidance device can comprise biasing means which are capable of being able to exert a restoring force in the direction of the support position or release position of the support roller arrangement. This means that the support roller arrangement, given the absence of an active control movement, by way of the restoring force of the biasing means is held in a restoring position which in particular corresponds to the support position or the release position. Basically a restoring position between the support position and the release position is also possible. The biasing means can for example comprise a rotary spring arranged on a rotation pivot of the link connection.

The support roller arrangement is moved via the pivot movement of the cam arm against the restoring force, out of the restoring position, for executing a movement in the support direction or in the release direction.

According to a further development of the invention, the device comprises a blowing air feed device, by way of which blowing air can be blown in between a lowermost object of a stack which at least partly is bent away by way of the separating member, and the stack. The blowing air is preferably applied in the form of a thrust of compressed air. This is preferably effected simultaneously or promptly with the bending or pulling away of the object from the stack lower side. Promptly means somewhat before the pulling away or somewhat before or after the bending away of the object, with regard to time and with respect to the duration of the operating cycle.

Thus control means can be provided, by way of which the blowing air can be blown in, in a controlled manner. The control means in particular are capable of blowing in the blowing air cyclically synchronously to the bending-away or the pulling-away of the object from the stack.

Moreover, the control means in particular are also in the position of producing a pulse-like thrust of compressed air.

An air cushion which simplifies the detachment of the lowermost object from the lower side of the stack is formed by way of blowing in blowing air between the lowermost object and the stack. The mentioned air cushion specifically effects a reduction of the static friction, so that the lowermost object can be singularised from the stack without any problem. In particular, by way of this measure, one prevents several objects being simultaneously detached from the stack due to the static friction prevailing between the objects of the stack.

According to a particularly preferred embodiment, the blowing air feed device comprises a blowing air channel. This in particular runs transversely to the movement direction of the support roller arrangement. The blowing air channel can be designed as a tube which in its lateral surface comprises exit openings for blowing air. The exit openings are accordingly directed towards the lowermost object of the stack.

The blowing air channel is preferably part of the support roller arrangement. Considered in the support direction, it is preferably arranged in front of the frontmost support roller of the support roller arrangement or itself forms the frontmost support roller. The blowing air channel preferably runs parallel to the rotation axes of the support rollers.

Support rollers can be rotatably mounted on the blowing air channel itself. The blowing air channel according to this example is designed as a hollow pivot.

The term "blowing air" here is representative for any gas or gas mixture which is suitable for reducing the static friction in the described way and manner.

According to a preferred further development of the device, the support means moreover comprise a stationary support arrangement which together with the support roller arrangement located in the support position, forms a common support surface. The support surface of the stationary support arrangement and/or of the support roller arrangement is preferably aligned horizontally or essentially horizontally. Essentially horizontally means that the support surface with respect to the horizontal has an inclination angle of maximal 10° (angle degrees). The support surface is preferably present as a support plane.

The stationary support arrangement preferably forms a stationary rest surface. The support arrangement can be a closed rest surface, e.g. in the form of a rest plate or rest sheet-metal piece. The rest surface can also be broken through.

A stationary guide roller can be arranged on the support arrangement or the stationary rest surface at the terminating edge which faces the support roller arrangement. The guide roller is rotatably mounted. The guide roller serves as a guide for the lowermost object of the stack which is to be separated away. The guide roller leads the objects transported away from the stack on its path downwards. This is effected by way of the object being led over the guide roller and deflected downwards. The guide roller thereby is set into a rotation by the object being moved past.

According to this further development of the device, the release gap is now arranged between the support arrangement or the guide roller, and the support roller arrangement located in the release position.

The device preferably comprises a plurality of separating members. The separating members are preferably arranged on a take-over device arranged below the support region. The separating members are preferably arranged over the perimeter on the take-over device. The take-over device can for example be a revolving carrier wheel, on whose radial peripheral region the separating members are arranged.

According to a further development of the invention, the device comprises a plurality of transport members for transporting the separated objects away from the stack. The transport members are preferably arranged on a take-over device arranged below the support region. The transport members are preferably arranged over the perimeter on the take-over device. The take-over device can for example be a revolving carrier wheel, on whose peripheral region the transport members are arranged.

The separating members and transport members can be arranged on the same take-over device or on the same carrier wheel. The separating members and transport members from a functional viewpoint in each case preferably form pairings.

The functional interaction of the separating member and transport member is hereinafter described in more detail with regard to the method.

According to a further development of the invention, the device comprises deactivation means, by way of which the movement of the support roller arrangement can be reduced with a continued revolving movement of the at least one separating member. The deactivation means are preferably designed such that the pivot movement of the cam arm does not act on the link mechanism of the roller guidance device, given a deactivation of the movement of the support roller arrangement. The deactivation means can e.g. be locking means or coupling means.

According to a further development of the invention, the device comprises rear stack space limitation means. The rear stack space limitation means are arranged at that end of the stack space which is away from the support roller arrangement. The rear stack space limitation means are preferably designed in the form of a stack space limitation wall. The stack space limitation wall can form a continuous or broken-through limitation surface or a limitation surface formed from part surfaces.

The stack space limitation wall in particular can comprise a vertical or essentially vertically aligned limitation surface. Essentially vertically aligned means that the limitation surface has an inclination angle of maximal 10° (angle degrees) with respect to the vertical. The vertical or essentially vertical limitation surface is preferably designed in a plane manner.

A terminating limitation surface which is angled or bent towards the support roller arrangement can connect to the vertical or essentially vertical limitation surface towards the support region. This terminating limitation surface is preferably likewise present as a wall section. The terminating limitation surface of the above-mentioned design has the effect that the lowermost object with its end section directed to the rear stack space limitation means is lifted from the support surface, in particular from the stationary support arrangement or is at least relieved. The static friction between the lowermost object and the support surface can be reduced by way of this.

The invention further also relates to method for separating individual, two-dimensional, flexible objects from the lower side of a stack of such objects and for conveying the separated objects away from the stack by way of a previously mentioned device.

The description of the method is effected beginning with a support roller arrangement which is located in a support position for supporting the stack. If the support means comprise a stationary support means arrangement, as the case may be with a guide roller, then the support roller arrangement in the support position is preferably arranged directly next to the support means arrangement or the guide roller and with this forms a continuous support surface.

Starting with the support position mentioned above, the method according to the invention is characterised by the following steps:

Moving the Support Roller Arrangement Along a Release Direction out of the Support Position Amid the Enlargement of a Release Gap The support roller arrangement with this procedure in particular is moved into a release position. The support roller arrangement in particular is moved away from the stationary support arrangement or from the guide roller. The release gap opens or widens thereby between the stationary support arrangement or the guide roller, and the support roller arrangement. The movement of the support roller arrangement is preferably translatory at least in sections and runs in particular parallel to the support surface.

Gripping the Lowermost Object of the Stack by the Separating Member

If the separating member is designed as a suction member, then the suction member moved from below into the support region sucks firmly on the lower side of the lowermost object. This is particularly the case in an end section supported by the support roller arrangement. The separating member preferably grips the object whilst the moving support roller arrangement enlarges the release gap.

Separating the Lowermost Object from the Stack by Way of Bending the Object Away from the Stack Lower Side into the Release Gap.

The separating member which firmly holds the lowermost object preferably bends this downwards away from the stack by way of a pivot movement. The separating member is pivotably designed via suitable pivot means. The object is preferably bent away from the stack lower side whilst the support roller arrangement moves in the support direction.

The bending-away is comparable to a peeling procedure. In this manner, the static friction acting in a surfaced manner between the lowermost object and the stack is avoided, at least on initiating the separating procedure. The object at least partly can be bent away from the stack over the width of the release gap.

Moving the Support Roller Arrangement in a Support Direction Opposite to the Release Direction, Amid the Reduction of the Release Gap.

The support roller arrangement with this procedure in particular is moved into the support position. The support roller arrangement is moved in the support direction back into its support position after or during the bending of the object away from the stack. The movement of the support roller arrangement is effected via suitable control means, useful in a cyclically synchronous manner to the movement of the separation members and as the case may be the transport members.

According to a preferred design of the method, the support roller arrangement already during the bending of the lowermost object away from the stack lower side is moved back from the release position in the direction of the support position. The support roller arrangement with this procedure is moved into the gap between the lowermost object and the stack in the direction of the support position.

With the presence of a stationary support arrangement, the lowermost object at this point in time, with a section of the object, is still arranged between the support arrangement and the stack. The mentioned object section forms an object part surface, with which the object lies on the stationary support arrangement.

Transporting the Object Away Through the Release Gap

In a further step, the complete transport of the lowermost object away from the stack is affected. The transport-away through the release gap in particular is effected from below. For this, the lowermost object is completely pulled from the stack and transported away below the stack, before, on or after reaching the support position of the support roller arrangement.

If this procedure is not effected until on or after reaching the support position of the support roller arrangement, then a release gap is formed between the support roller arrangement and the stationary support arrangement or the guide roller. This however is significantly narrower than the maximal release gap in the release position, since space must be provided for the latter for bending away the lowermost object downwards out of the stack space.

One can also envisage a clamping release gap being formed in the support position and being designed so large that the guide roller and the frontmost roller of the support roller arrangement which is arranged towards the guide roller lead the object on both sides through the release gap in a clamping manner.

With this procedure, the separating member now moves the lowermost object as a result of its continued movement along its revolving path preferably further away from the stack. The object is subsequently transported away downwards through the mentioned release gap.

If the device moreover comprises transport members which are co-moved along a revolving path likewise running below the support region, then the separating element transfers the object to a transport member cooperating with the separating member, during or subsequently to the bending-away.

If the support means form a stationary support means arrangement of the type described above, then the partly bent-away object with its remaining object section must still be pulled out between the stack and the stationary support means arrangement.

The transport member pulls the lowermost object completely from the stack as a result of its continued movement along its revolving path and transports this away downwards. The transport member can yet additionally execute a pivot movement via suitable pivot means, for assisting the transport-away and for treating the object in a gentle manner.

The device can comprise a conveying-away device, such as e.g. a belt conveyor, to which the objects singularised from the stack are transferred by the transport member. The objects which are singularised from the stack and transported away can be transferred e.g. individually or as an imbricate stream to a belt conveyor. The conveying-away device can however also contain a gripper conveyor.

On pulling the object section remaining between the stack and the stationary support means arrangement away from the stack, one must take the problem of the static friction into account.

For this, the device according to a further development of the invention preferably comprises a blowing air feed device. Blowing air is blown with this between the at least partly bend-away, lowermost object and the stack, during the bending of the lowermost object away from the stack. An air cushion reducing the static friction is formed between the lowermost object and the stack by way of the feed of blowing air. This permits a reliable pulling of the object away from the stack. The blowing air is preferably blown in via at least a part of the total width of the object transverse to the movement direction of the support roller arrangement.

The present device is simple in it construction and operation, in comparison to the initially mentioned devices from the state of the art. The device can moreover be designed in a very compact and accordingly space-saving manner due to its particular mechanical manner of functioning. For this reason, the device according to the invention is in particular suitable for processing installations with restricted spatial conditions. Moreover, the present device is inexpensive and simple with regard to manufacture, in comparison to the devices with complex roller revolving guides, known from the state of the art.

BRIEF DESCRIPTION OF THE DRAWINGS

The subject-matter of the invention is hereinafter explained in more detail by way of preferred embodiment examples which are represented in the accompanying drawings. There are shown in.

Basically, the same parts are provided with the same reference numerals in the figures.

DETAILED DESCRIPTION OF THE INVENTION

FIGS. 1 to 4 show a specific embodiment of the present invention. FIGS. 3*a* to 3*d* in particular show the method course with regard to the separation and transport of objects away from a stack.

Figure 4:
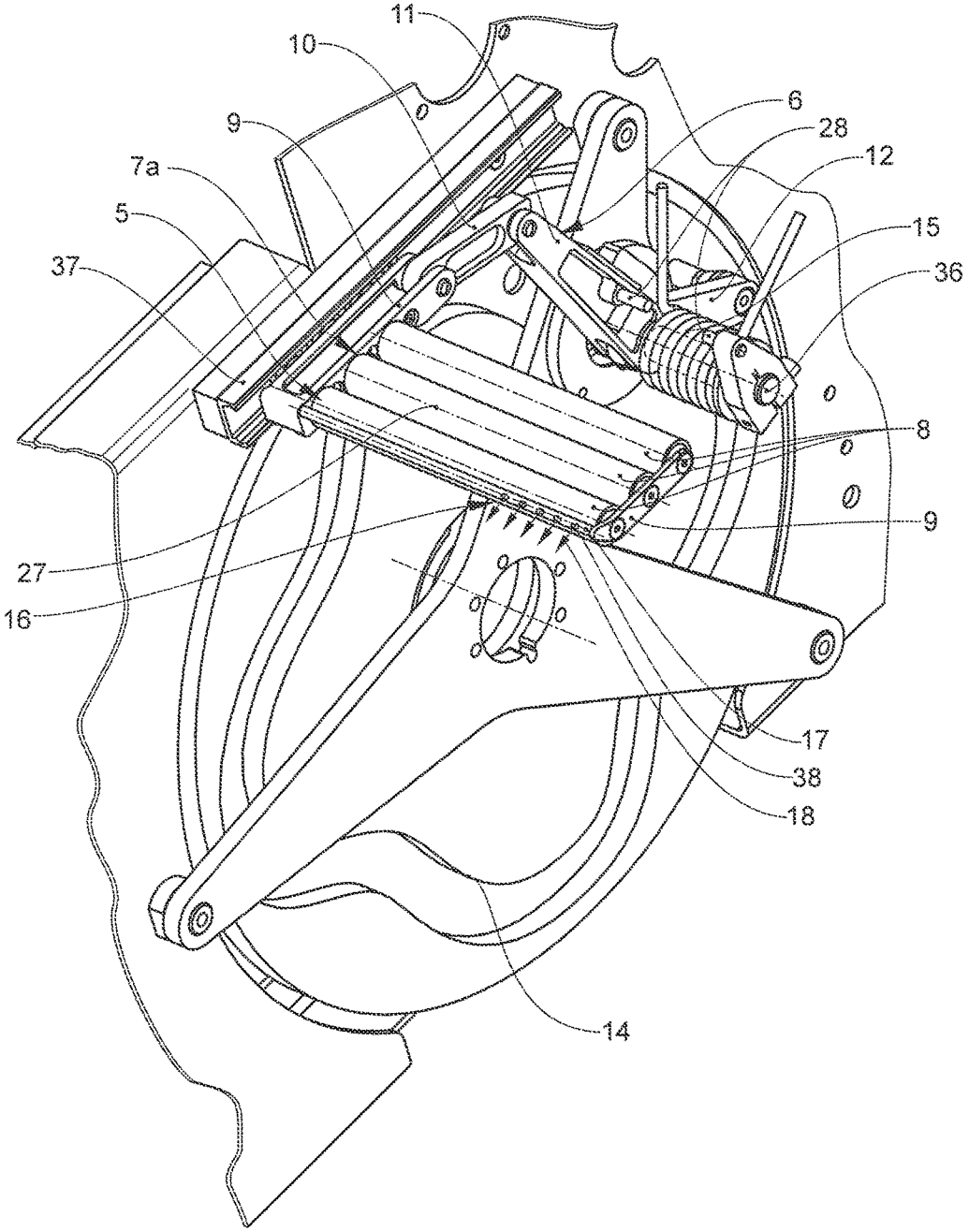
FIG. 4 is a perspective view of the device according to FIGS. 1 to 3, from the region of the support roller arrangement.
Figure 5:
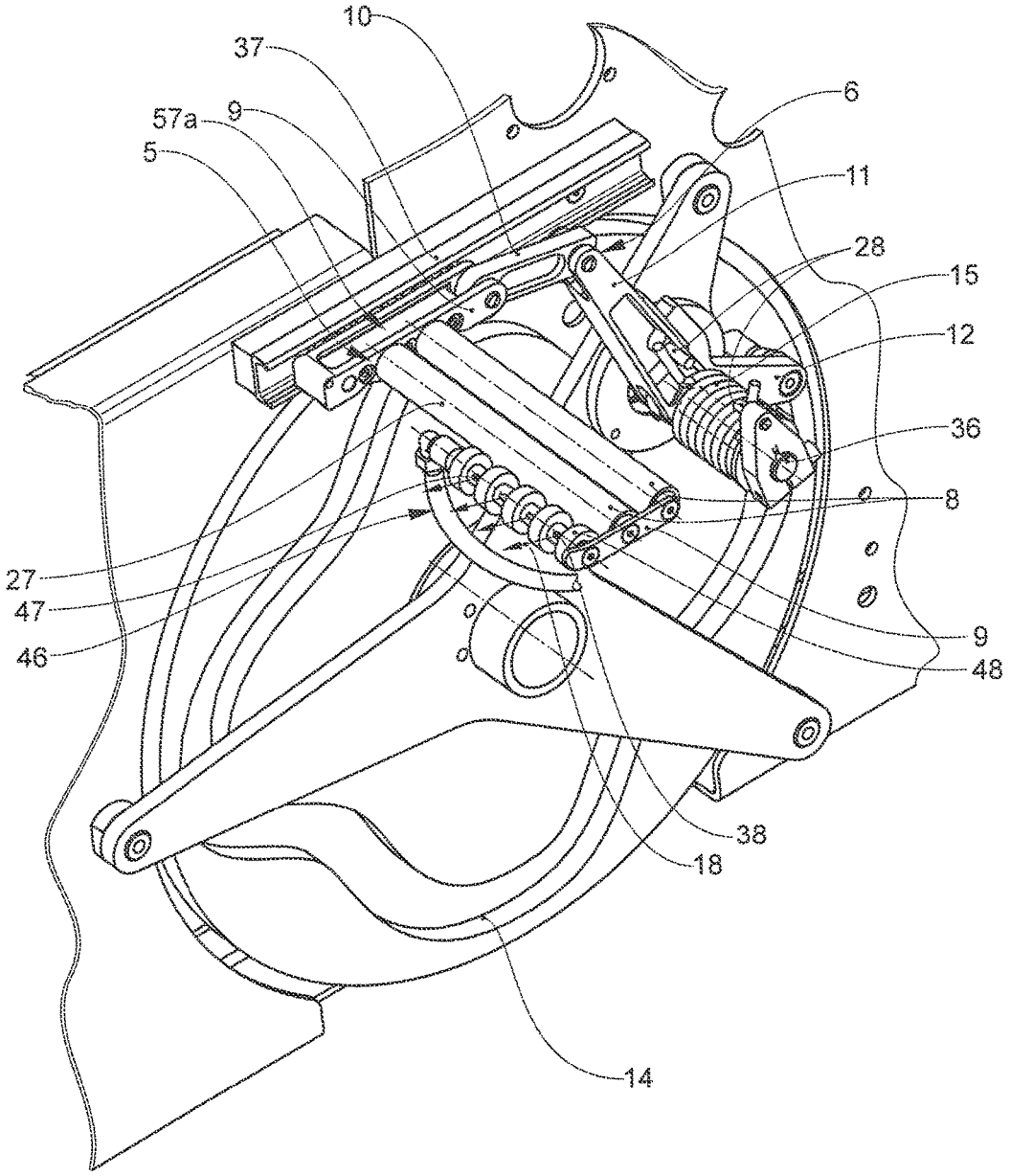
FIG. 5 is a perspective view of the device according to FIGS. 1 to 3, from the region of the support roller arrangement, with an alternative embodiment of the support roller arrangement.

FIG. 5 shows an alternative embodiment of a support roller arrangement and of a blowing air device which however in the device according to the FIGS. 1 to 4 can be applied as an alternative embodiment to the support roller arrangement and blowing air device which are shown there.

The device 1 forms a stack space 4 which receives a stack 3 of two-dimensional, flexible objects 2. The flat sides of the objects 2 are orientated perpendicularly to the gravity direction G. The object 2*a* of the stack 3 which is lowermost in the gravity direction G lies with its flat side on support means supporting the stack 3 from below. The support means for this form a plan support means surface.

The support means comprise a stationary support arrangement 22 which forms a type of rest table for the part-surfaced support of the stack 3. Part-surfaced means that the stationary support arrangement 22 supports the stack only over a first part of the surface side of the lowermost object 2*a*. The rest table forms a support surface 27.

A stationary, rotatably mounted guide roller 23 connects to the stationary support arrangement 22 in a release direction FR which is hereinafter yet described in more detail. This guide roller is part of the stationary support arrangement 22. Moreover, considered in the release direction FR, two support roller arrangements 7*a*, 7*b* of a roller guidance device 6 which are designed in a mirror-symmetrical manner and are arranged next to one another and distanced to one another, connect to the stationary guide roller 23. The support roller arrangements 7*a*, 7*b* in each case likewise form a part of the support surface 27 for the stack 3. The support surface 27 of the support roller arrangements 7*a*, 7*b* lies in the same plane as the support surface 27 of the stationary support arrangement 22.

A central gap 32 is formed between the two support roller arrangements 7*a*, 7*b*, through which gap separating members 19 arranged on a carrier wheel 21 can be moved into the support region. The carrier wheel 21 is arranged below the support region 5.

The separating members are present as suction members 19. These, as described in more detail hereinafter, are led by the rotating carrier wheel 21 along their revolving path in a cyclically controlled manner into the support region 5 and out of this again, for the purpose of gripping the objects 2*a* from the stack 3. The suction members 19 according to FIG. 1 comprise two suction disks. The suction members however can also comprise only one or more than two suction disks.

Transport members in the form of grippers 20 which are likewise moved by way of the rotating carrier wheel 21 along a revolving path are likewise attached onto the carrier wheel 21. A suction member 19 and a gripper 20 in each case form a pairing. In total four pairs with a suction member and gripper, are arranged along the periphery of the carrier wheel in a manner distanced to one another, in the present embodiment example.

The pairing is of a functional type and is characterised in that the suction member 19 transfers an object 2*a* bent away from the stack 3, to the gripper 20 of the pairing assigned to this, for the transport away.

The two support roller arrangements 7*a*, 7*b* are then periodically and translatorily movably guided between a support position SP and a release position FP. In the support position SP, the support roller arrangement 7*a*, 7*b* connects to the stationary support arrangement 22 or to its guide roller 23. The support arrangement 22 and the support roller arrangement 7*a*, 7*b* form a common support surface. This support surface is continuous in the broadest sense.

In the release position FP, the support roller arrangement 22 is maximally distanced to the stationary support arrangement 22. A release gap 33 is formed between the support arrangement or the guide roller 23, and the support roller arrangement 7*a*, 7*b*.

Figure 1:
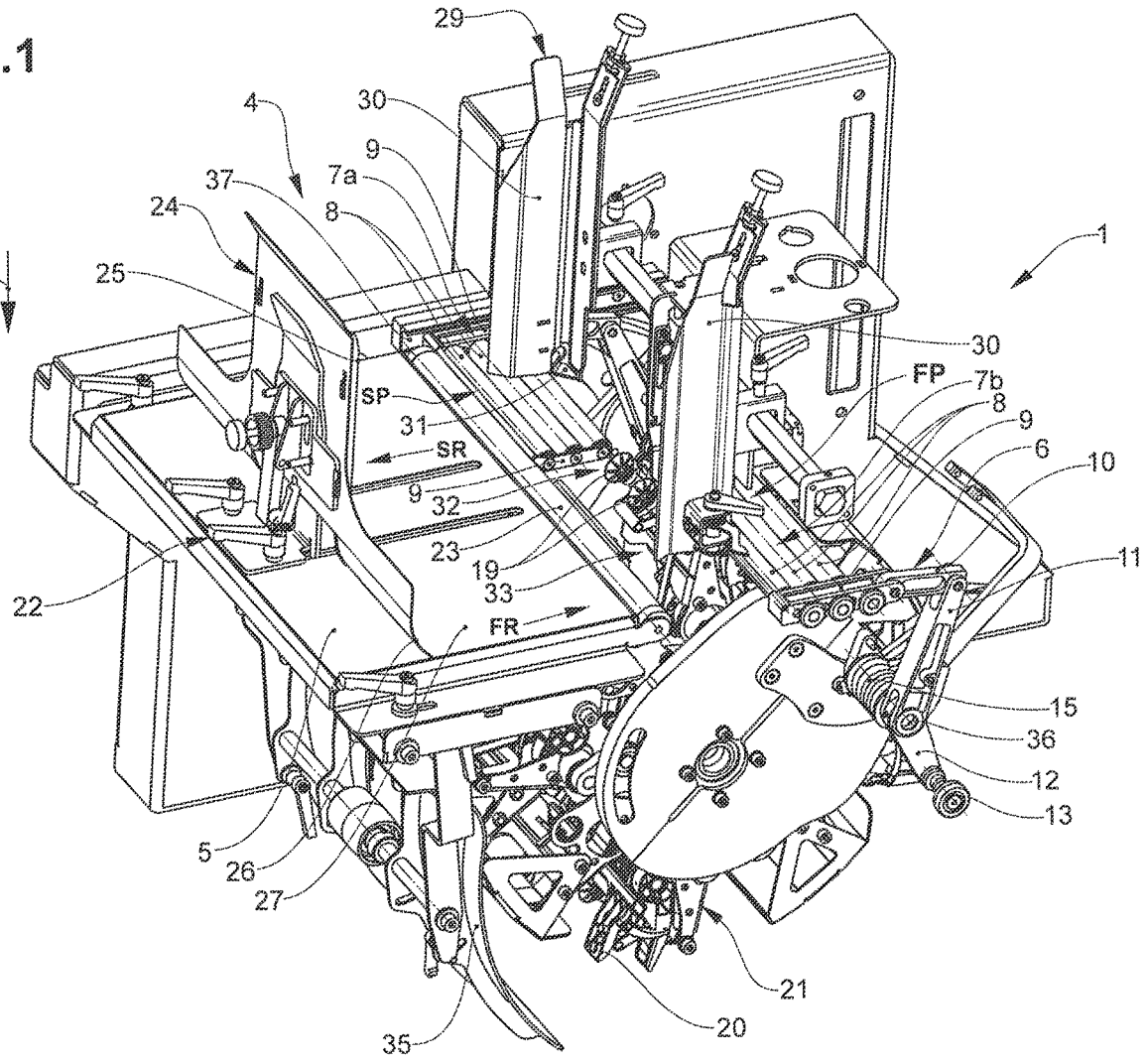
FIG. 1 is a perspective view of a device according to the invention.
Figure 2:
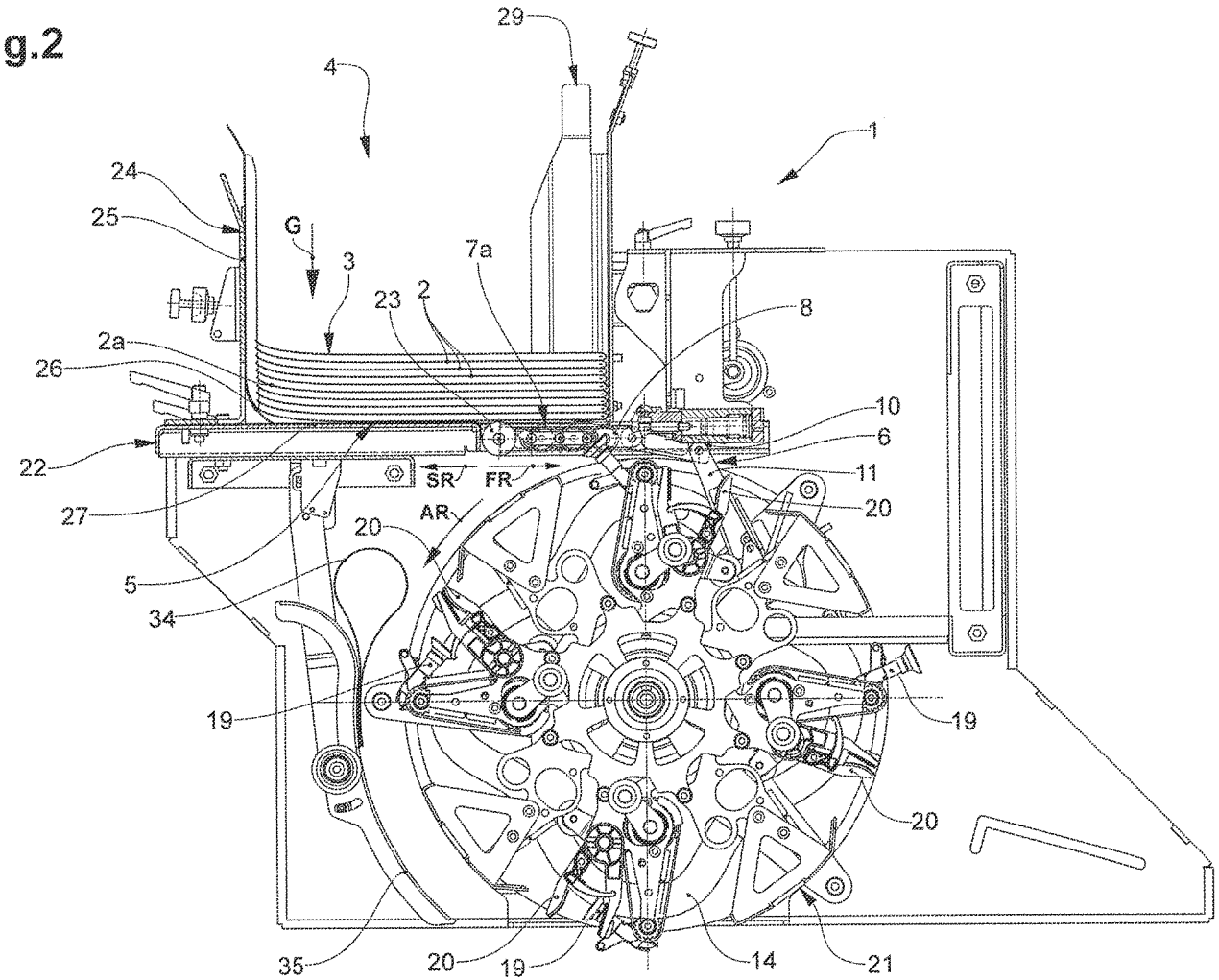
FIG. 2 is an elevation lateral view of the device according to the invention and according to FIG. 1.
Figure 3A:
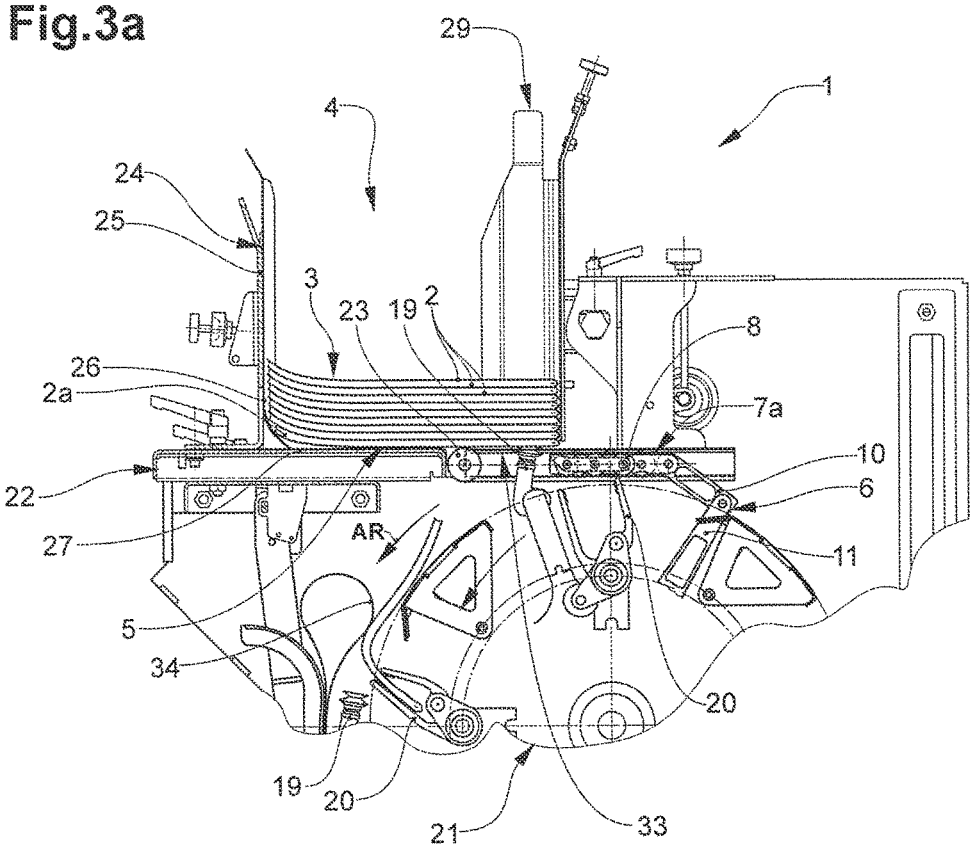
FIGS. 3*a*-3*d* are elevation views that illustrate the course of the method according to the invention, according to FIG. 2.
Figure 3B:
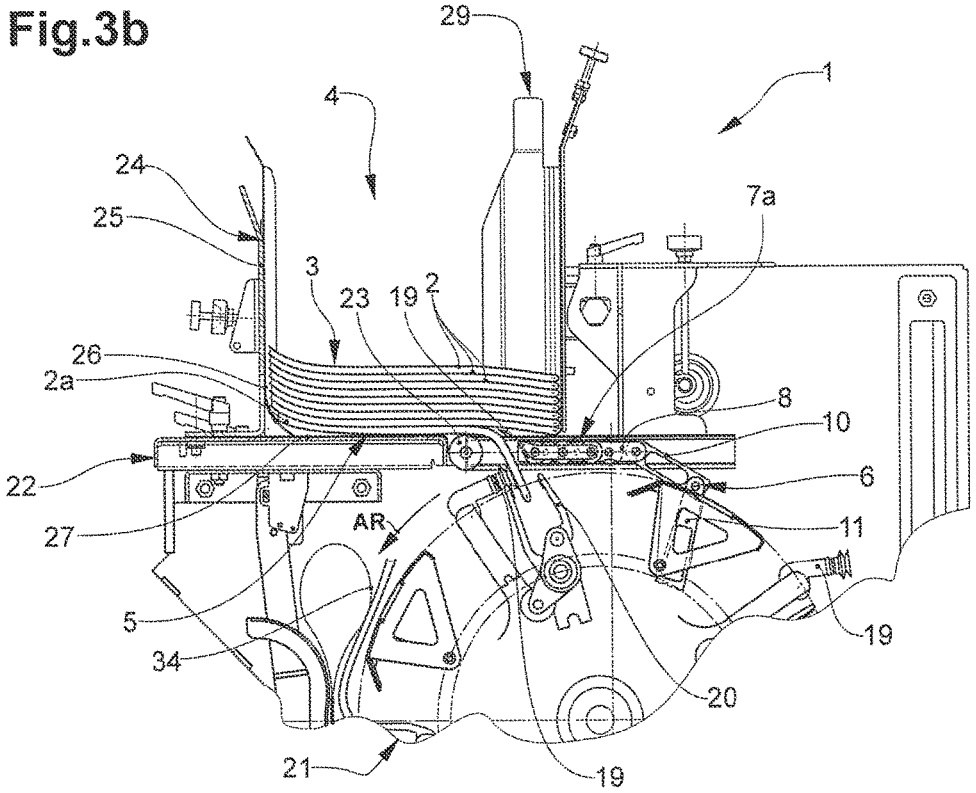
Figure 3C:
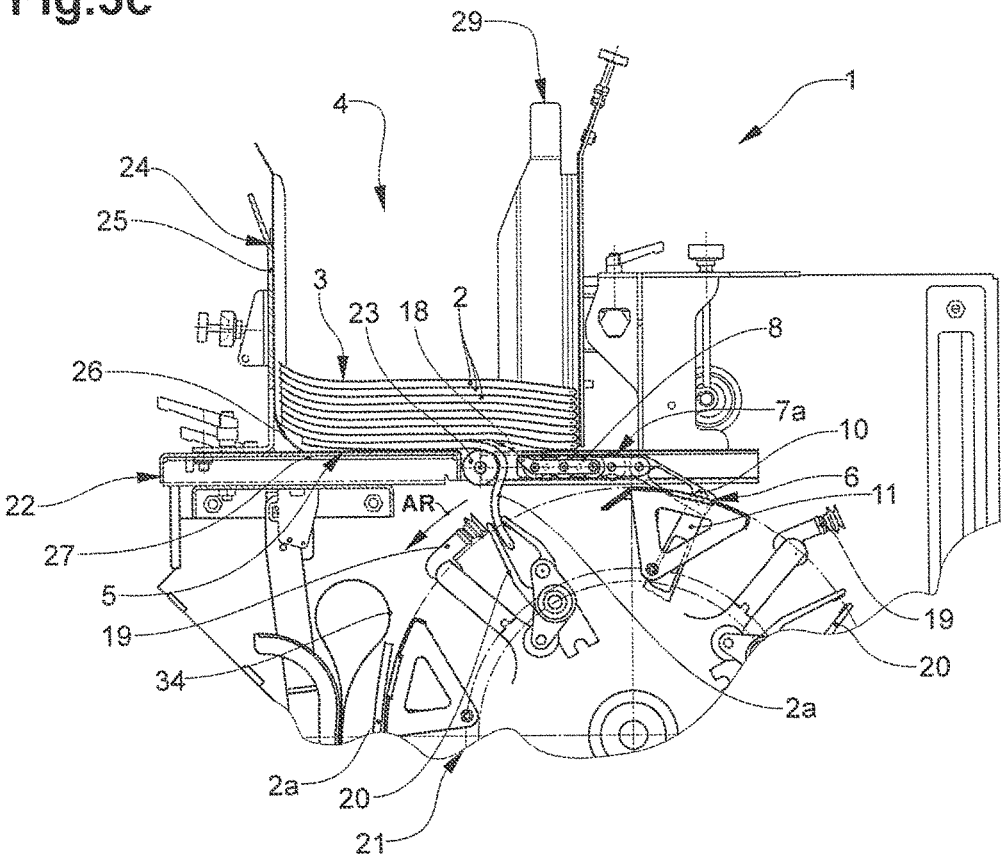
Figure 3D:
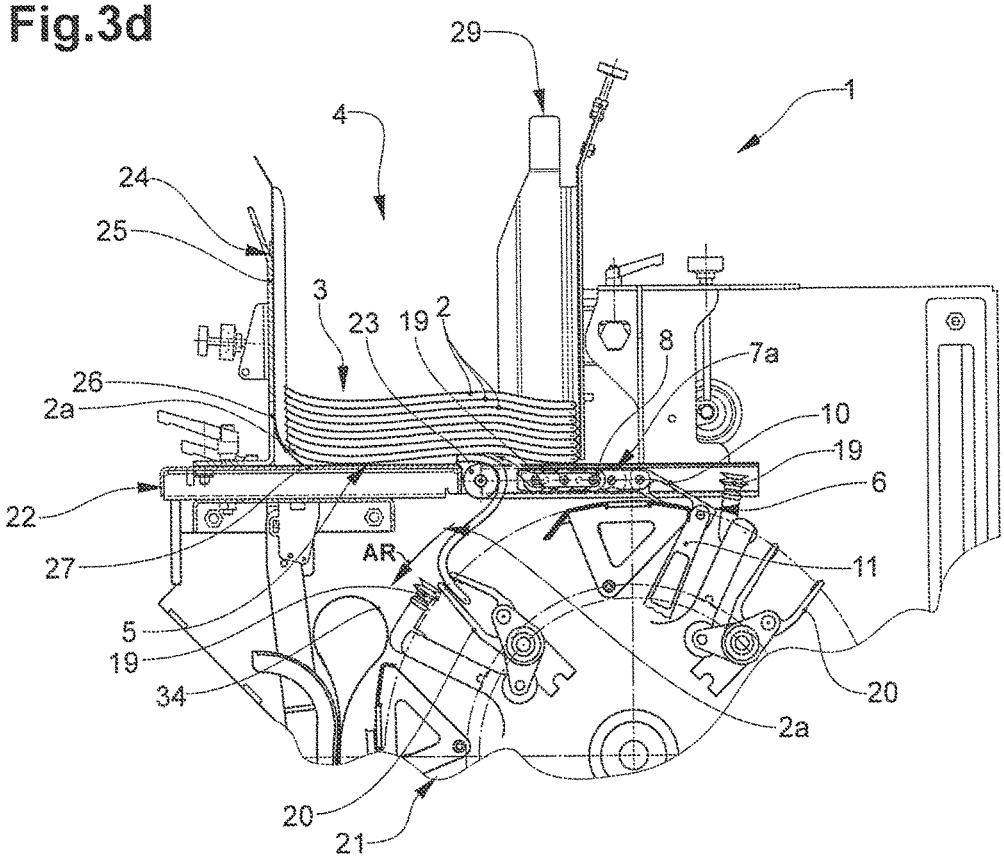

In FIG. 1, the one support roller arrangement 7*a*, 7*b* of the roller guidance device 6 for illustration is in the support position SP and the support roller arrangement 7*a*, 7*b* arranged on the other side of the central gap 32 is shown in the release position FP. Of course both support roller arrangements 7*a*, 7*b* are led synchronously in regular operation of the device.

The support roller arrangement comprises three support rollers 8 arranged one after the other in the release direction FR. The exact number of support rollers however is not essential to the invention. The support rollers 8 are rotatably mounted in laterally arranged roller carriers 9. The roller carriers 9 are designed as longitudinal profiles which extend along the release direction FR.

The roller guidance device 6 moreover comprises lateral guide profiles 37 which are part of a carriage guide. The roller carriers 9 designed as carriages are thereby led in the guide profiles 37.

The periodic and translatory movement of the support roller arrangement 7*a*, 7*b* is controlled via mechanical cam guidance. For this, the support roller arrangement 7*a*, 7*b* is coupled via a first and second link arm 10, 11 and via a link shaft 36, to a cam arm 12. A rotatably mounted cam roller 13 is attached at the distal end of the cam arm 12. The cam roller 13 is actively connected to a control cam 14. The control cam 14 is connected to the carrier wheel 21 in a rotationally fixed manner and accordingly rotates with the carrier wheel 21. The cam roller 13 accordingly rolls on the cam path of the control cam 14 which moves past.

For executing a translatory movement, the control cam 14 via the rolling cam roller 13 activates a pivot movement of the cam arm 12. The rotational pivot movement 13 of the cam arm 12 is converted via the link connection of the first and second link arm 11, 12 into a periodic and translatory movement of the support roller arrangement 7*a*, 7*b*.

The cam arm 12 for this is connected to a link shaft 36 in a rotationally fixed manner. The second link arm 11 of the link connection in contrast is rotatably mounted on the link shaft 36. The link shaft 36 is led by a biasing means in the form of a rotatory spring 15. The rotary spring 15 bears with its first limb on a first bolt 28 of a component co-rotating with the link shaft 36. Moreover, the rotary spring 15 with its second limb bears on a second bolt 28 connected to the second link arm 11.

The pivot movement of the cam arm 12 causes a rotation of the shaft 36 which via the first bolt and the first limb exerts a torsion movement onto the rotary spring 15. The torsion movement is transmitted from the rotary spring 15 via the second limb and the second bolt 28 onto the second link arm 11. The second joint arm 11 is set into a rotation movement by way of this.

The rotation movement of the second link arm 11 now moves the first link arm 10 which is articulately attached on the distanced end of the second joint arm 11, along an arc-shaped movement path. The first joint arm 10 with its other end is articulately connected to the support roller arrangement 7*a*, 7*b*, i.e. to the roller carrier 9 and transmits the movement into a translatory movement of the support roller arrangement 7*a*, 7*b* along the carriage guide.

The rotary spring 15 moreover due to its biasing can exert a restoring force in the form of a torque onto the second link arm 11. This restoring force has the effect that the support roller arrangement 7*a*, 7*b* is guided via the link arrangement 10, 11 into the release position SP.

The device moreover comprises deactivation means in the form of blocking or locking means, which are to prevent the movement of the link arms 10, 11 and thus the movement of the support roller arrangement 7*a*, 7*b* out of the support position SP. The blocking or locking means are necessary, if despite the separating member 19 continuing to revolve, no objects 2*a* are to be pulled from the stack 3.

The control cam 14 which rotates further with the carrier wheel 21, although continuing to exert a control movement of the cam arm 12, the torsion moment exerted by the pivot movement of the cam arm 12 onto the rotary spring 15 is however accommodated and compensated by the rotary spring 15. The rotary spring 15 is additionally tensioned by this procedure.

The stack space 4 in its rear end lying opposite to the release direction FR is limited by rear stack space limitation means 24. The stack space limitation means are present as a stack space limitation wall 24. The stack space limitation wall 24 forms a vertically aligned limitation surface 25. A terminating limitation surface 26 which is bent towards the support roller arrangement 7*a*, 7*b* connects onto the vertical limitation surface 25 towards the support region 5.

The stack space moreover is limited in its front end lying in the release direction FR by way of front stack space limitation means 29. The front stack space limitation means 29 comprise vertically arranged angle elements 30 which define a stack space limitation in the corner regions of the rectangular objects 2 of the stack 3. The angle elements 30 at their lower termination each comprise a corner support element 31. These form a rest surface for the corner regions of the lowermost object 2*a*. The size of the corner support elements 31 and accordingly also the size of the rest surface are dimensioned and limited in a manner such that the objects 2*a* can be pulled away downwards via the corner support elements 31 without any problem.

Adjustment means are moreover provided, which permit an adjustment of the front and rear stack space limitation means 24, 29. In this manner, the stack space 4 can be adapted to the different object formats by way of adjusting the stack space limitation means 24, 29. The adjustment mechanism is not dealt with in more detail at this location, since it is not essential to the invention.

The method shown in FIGS. 3*a* to 3*d* for singularising objects from a stack and for transporting these away from takes its course as follows.

In an initial position, the support roller arrangement 7*a*, 7*b* is arranged in its support position SP, in which this directly connects to the stationary support arrangement 22 or to its guide roller 23. I.e., in the support position SP, no or a narrow gap is formed between the support arrangement 22 or the guide roller 23, and the support roller arrangement 7*a*, 7*b*.

For removal of the lowermost object 2*a* from the stack 3, a suction member 19 moved along a revolving path on the carrier wheel 21 is now led up and onto the lower side of the lowermost object 2*a* in its end section supported by the support roller arrangement 7*a*, 7*b*. For this, the suction member 19 is moved through the central gap 32 between the two support roller arrangements 7*a*, 7*b*.

The support roller arrangement 7*a*, 7*b*, simultaneously or even before this, is moved in the release direction FR away from the stationary support arrangement 22. A release gap 33 opens (see FIG. 3*a*).

The suction member 19 grips the lowermost object 2*a* on its front end section and bends this downwards away from the stack lower side. The bending-away downwards is effected via a superimposed movement, consisting of a pivot movement of the suction member 19 about a pivot axis as well as a rotation movement of the suction member 19 with the carrier wheel 21. The front end section of the object 2*a* is accordingly led downwards through the release gap 33 (see FIG. 3*b*).

With regard to the objects 2 pulled away from the stack 3, it is the case of multi-page printed products each with a fold and a cut edge. The objects 2*a* are then bent away downwards with the fold in front and transported away.

During the bending-away of the lowermost object 2*a* by way of the suction member 19, the support roller arrangement 7*a*, 7*b* is moved back in the support direction SR opposite to the release direction FR, back in the direction of the support position SP. The support roller arrangement 7*a*, 7*b* thereby moves in between the bent-away object 2*a* and the stack 3. In this manner, an as early as possible support of the stack 3 in the region of the release gap 33 is ensured, specifically already before the lowermost object 2*a* has already been pulled away (see FIG. 3*b*).

Moreover, by way of a blowing air feed device 16, blowing air is blown in between the at least partly bent-away lowermost object 2*a* and the stack lower side, during the bending-away of the lowermost object 2*a*. By way of this, an air cushion reducing the static friction is formed between the lowermost object 2*a* and the stack lower side, during the bending-away of the lowermost object 2*a*. The reduction of the static friction permits a reliable removal of the lowermost object 2*a* from the stack lower side.

A first embodiment variant of a blowing air device 16 is shown in FIG. 4, which shows an enlarged part detail from the region of the support roller arrangement 7*a*. This comprises a blowing air tube 17 arranged transversely to the movement direction of the support roller arrangement 7*a* and having air exit openings 38 which are directed to the stack lower side (not shown). The blowing air tube 17 is designed as part of the support roller arrangement 7*a* and is arranged running in front of the frontmost support roller 8 seen in the support direction SR as well as parallel to the rotation axes of the support rollers 8. The blowing air 18 on retracting or moving back the support roller arrangement 7*a* in the support direction SR is now blown through the air exit openings 38 towards the gap opening between the bending-away, lowermost object 2*a* and the stack lower side.

An alternative embodiment of a blowing air feed device 46 is shown in FIG. 5. The blowing air feed device 46 analogously to the embodiment variant according to FIG. 4 comprises a blowing air tube 47 which is arranged transversely to the movement direction of the support roller arrangement 57*a* and having air exit openings 38 directed towards the stack lower side (not shown). The blowing air is fed via a blowing air flexible tubing to the blowing air tube.

The blowing air tube 47 is likewise designed as part of the support roller arrangement 57*a* and, considered in the support direction SR is arranged running in front of the support rollers 8 as well as parallel to the rotation axis of the support rollers 8. Now according to this embodiment, several additional support rollers 48 which are rotatably mounted and are arranged in a manner distanced to one another along longitudinal axis of the blowing air tube 47 are arranged on the blowing air tube 47. The blowing air tube 47 forms a roller pivot designed as a hollow pivot, for the additional support rollers 48. The mounting of the additional support rollers 48 on the roller pivot can be effected via suitable ball bearings. The individual, additional support rollers 48 which are arranged next to one another transversely to the movement direction of the support roller arrangement 57*a* likewise serve for the support of the stack 3 in the support position SP.

The blowing air 18 with this embodiment, on retracting the support roller arrangement 57*a* in the support direction SR, is now blown through air exit openings 38 towards the gap opening between the bending-away lowermost object 2 and the stack lower side. The air exit openings 38 are arranged between the additional support rollers 48.

In a further development of the method, the suction member 19 now transfers the object 2*a* to a gripper which is likewise co-moved in a revolving manner with the carrier wheel 21. The gripper 20 now pulls the gripped object 2*a* downwards completely away from the stack 3. With this procedure, the object 2*a* is pulled away downwards around the guide roller 23 (see FIGS. 3*c* and 3*d*).

The support roller arrangement 7*a*, 7*b* again reaches its support position SP with the pulling of the object 2*a* away from the stack 3. A new operating cycle can begin.

The transferring suction member 19 and the taking-over gripper 20 form a pairing. The manner of operation of the suction members 19 and grippers 20, which are led in a revolving manner on a common carrier wheel 21, is already known from the state of the art mentioned in the description introduction and is therefore no longer described in all details at this location.

The translatory movement of the support roller arrangement 7*a*, 7*b* is of course controlled in a cyclically synchronous manner with the movement of the suction members 19 and grippers 20. The movement of the suction members 19 as well as of the grippers 20 along their revolving path and, as the case may be, the pivot movement of the suction members and grippers about a pivot axis and the closure and opening movement of the grippers can likewise be effected via control cams.

The device 1 moreover also comprises a damping element 34 in the form of an elastic loop which damps the radial deflection of the trailing end section of the object 2*a*, said deflection being produced by way of pulling down the object 2*a*.

LIST OF REFERENCE NUMERALS

1 device
2 objects
2*a* lowermost object
3 stack
4 stack space
5 support region
6 roller guidance device
7*a*, 7*b* support roller arrangement
8 support rollers
9 roller carrier
10 first link arm
11 second link arm
12 cam arm
13 cam roller
14 control cam
15 biasing means (rotary spring)
16 blowing air feed device
17 blowing air channel
18 blowing air
19 separating member (sucker)
20 transport member (gripper)
21 take-over device (carrier wheel)
22 stationary support arrangement
23 guide roller
24 rear stack space limitation means
25 vertical limitation surface
26 terminating limitation surface
27 support surface
28 bolt
29 front stack limitation means
30 angle elements
31 corner support element
32 central gap
33 release gap
34 damping element (elastic loop)
35 guide plate
36 link shaft
37 carriage guidance
38 air exit openings
46 blowing air feed device
47 blowing air channel
48 support rollers
57*a* support roller arrangement
SP support position
FP release position
FR release direction
SR support direction
AR movement direction of the separating members
G gravity direction

The invention claimed is:

1. A device for separating individual, two-dimensional, flexible objects from a lower side of a stack of two-dimensional, flexible objects and for conveying the separated objects away from the stack, comprising:

a stack space with a support region;

a support member that supports the stack from below in the support region, wherein the support member comprises two support roller arrangements with at least one support roller and a stationary support arrangement; and at least one separating member for separating the objects from the lower side of the stack, wherein the two support roller arrangements are arranged next to one another considered in the movement direction of the support roller arrangements, wherein between the support roller arrangements a central gap is formed which extends along the movement direction of the support roller arrangements and through which the at least one separating member can be moved towards the support region for the purpose of gripping the lowermost object of the stack, wherein the support roller arrangements are part of a roller guidance device, and the support roller arrangements are periodically movable between a support position and a release position, wherein the stationary support arrangement forms together with the support roller arrangements, located in the support position, a common support surface for the stack, wherein the movement of the support roller arrangements, at least along the support surface, is translatorily and parallel to the support surface, and wherein between the stationary support arrangement and the support roller arrangements, located in the release position, a release gap is formed, and wherein the width of the release gap can be enlarged or reduced due to the movement of the support roller arrangements between the support position and the release position.

2. The device according to claim 1, wherein the support roller arrangements at least in sections are movable along an arcuate movement path.

3. The device according to claim 1, further comprising a controller that is operable to control movement of the support roller arrangements in a cyclically synchronous manner to the separating procedure.

4. The device according to claim 1, further comprising biasing members that are capable of exerting a restoring force in the direction of the support position or release position of the support roller arrangements.

5. The device according to claim 1, further comprising a blowing air feed device that is adapted to blow air in between a lowermost object of a stack, which is at least partly bent away by the separating member, and the stack.

6. The device according to claim 1, wherein a stationary guide roller, which is arranged in the support region, connects to the stationary support arrangement towards the support roller arrangements.

7. The device according to claim 1, wherein the at least one separating member is arranged on a take-over device arranged below the support region.

8. The device according to claim 1, further comprising at least one transport member for transporting the separated objects away from the stack, and the at least one transport member is arranged on a take-over device arranged below the support region.

9. The device according to claim 7, further comprising a deactivation device that is operable to stop movement of the support roller arrangements given a continued revolving movement of the at least one separating member.

10. The device according to claim 1, further comprising a rear stack space limitation member that forms an essentially vertical limitation surface, and towards the support region comprises a wall section that is angled or bent in the direction of the support roller arrangements.

11. The device according to claim 1, wherein the support roller arrangements form a roller carpet.

12. A method for separating individual, two-dimensional, flexible objects from a lower side of a stack of two-dimensional, flexible objects and for conveying the separated objects away from the stack by way of the device according to claim 1, wherein the support roller arrangements are located in the support position for supporting the stack, comprising the following steps:

moving the support roller arrangements at least along the support surface translatorily and parallel to the support surface along a release direction out of the support position to enlarge the release gap;

moving the at least one separating member through the central gap towards the support region;

gripping the lowermost object of the stack by way of the at least one separating member;

separating the lowermost object from the stack by way of bending the object away from the stack lower side into the release gap;

moving the support roller arrangements in a support direction opposite to the release direction to reduce the release gap;

transporting away the object through the release gap.

13. The method according to claim 12, wherein the support roller arrangements are moved in the support direction already during the bending of the object away from the stack lower side.

14. The method according to claim 12, wherein the at least one separating member grips the object while the moving support roller arrangements enlarge the release gap.

15. The method according to claim 12, wherein the object is bent away from the stack lower side while the support roller arrangements move in the support direction.

16. The method according to claim 12, wherein the device comprises a controller that is operable to control movement of the support roller arrangements in a cyclically synchronous manner with the separating step of the objects.

17. The method according to claim 12, wherein the device comprises a blowing air feed device that is operable to blow air in between the at least partly bent-away, lowermost object and the stack, during the bending of the lowermost object away from the stack, by way of the blowing air feed device.

* * * * *